United States Patent [19]

White et al.

[11] 4,339,788

[45] Jul. 13, 1982

[54] LIGHTING DEVICE WITH DYNAMIC BULB POSITION

[75] Inventors: Robert D. White, Warwick, N.Y.; Donald P. Weiss, Cliffside Park, N.J.

[73] Assignee: Union Carbide Corporation, Danbury, Conn.

[21] Appl. No.: 178,446

[22] Filed: Aug. 15, 1980

[51] Int. Cl.[3] ..... F21L 7/00

[52] U.S. Cl. ..... 362/157; 362/200; 362/201; 362/202; 362/203; 362/205

[58] Field of Search ..... 362/157, 200, 201, 202, 362/203, 205

[56] References Cited

U.S. PATENT DOCUMENTS 4,285,030 8/1981 Menelly ..... 362/200

*Primary Examiner*—Stephen J. Lechert, Jr.
*Attorney, Agent, or Firm*—Cornelius F. O'Brien

[57] ABSTRACT

A portable, self-contained lighting device with improvements in bulb positioning, switching, and electrical contact wherein (a) the bulb position changes axially depending on the presence or absence of the power source;

(b) the rotating switch is positioned essentially directly above the bulb; and (c) the electrical contact strip is preloaded against the switch assembly in the "off" position and has an overtravel capacity of up to about 50% with a compensating flexible knee capable of changing by up to about 40°.

4 Claims, 15 Drawing Figures

LIGHTING DEVICE WITH DYNAMIC BULB POSITION

BACKGROUND OF THE INVENTION

Recently the portable lighting device market has enjoyed excellent growth. However, during this period there has been a growing ground swell of negative consumer attitudes towards certain aspects of these lighting devices which could eventually culminate in limiting further growth of the market. For example, there appears to be concern about (a) increased cost and complexity of these devices with diminishing "apparent value";
(b) product malfunctioning including failure to make electrical contact, bulb out of focus, defective switching, etc.;
(c) bulb and power source replacement is complicated and/or difficult;
(d) poor design, particularly as to location, actuation and movement of the switch; and
(e) excessive bulb failure and/or bulb maladjustment relative to the reflector attributed to variations in bulb length, bulb terminal and/or the fit of the bulb, with the screw shell and bumper block assemblies.

Most portable lighting devices today are assembled by threading the head assembly into the body assembly. The amount of force used in assembling these two components to "tighten down" often determines whether effective electrical contact is made between the power source and the electrical contact elements. Thus, in addition to being a costly way of assembling, this arrangement inherently has a built-in variable that can adversely affect electrical contact and performance of the device, i.e., the extent to which the two units are screwed together becomes critical. Ideally, the electrical contact should be based on a pre-set condition that accommodates power source dimensional variables. These pre-set conditions are preferably relatively constant from one lighting device to another, and should not allow for variation by the consumer during power source replacement and/or bulb replacement. In addition, these pre-set conditions should preferably accommodate the variations in battery terminal length and bulb dimensional variations.

Heretofore, most lanterns have secured the bulb in a fixed position substantially free from movement. Generally this was achieved by the use of a metallic insert in the reflector core generally described as a screw shell which held the bulb in the reflector core and provided the means for electrical contact with the switch assembly. A second element, generally described as a bumper block, engaged the screw shell by means of threading into the screw shell, contact with the bulb terminal being made by means of a metal spring fixedly secured into the bumper block. The spring in the bumper block served a dual function of making electrical contact with the bulb terminal as well as functioning as a kind of shock absorber for the bulb. The bumper block comprises generally a non-conductive core element in contact with a metal disc member which is seated in the head assembly substantially with no axial movement. Heretofore the contact disc has been in continuous electrical contact with the terminal springs of the power source and in electrical contact with the contact strip when the switch assembly is moved to the "on" position. Thus, the spring action of the terminal springs has traditionally been limited to making electrical contact with the disc and has not been employed to make contact with the bulb directly. The bumper block spring/bulb base arrangement is such that the bulb can become tilted in the screw shell, resulting in less than optimum focus.

Up to the present there has been little consideration given to the optimum means for effecting electrical contact between the switch assembly, the bulb, and the power source while maintaining the bulb in focus. Certain arrangements used heretofore have been observed to eventually fail to make effective reliable contact either with the bulb and/or the power source. For example, those arrangements that rely on a sliding-type movement for the contact strip to engage the bulb appear to have inherent performance problems. Similarly, those arrangements which permanently affix the contact strip to the screw shell or other bulb holding means appear to run a risk of strip fatigue in the area of electrical contact with the screw shell, or the means for permanently affixing the strip fails resulting in an electrical short.

Contact with the power source is traditionally made by the contact strip making electrical contact with the contact disc that is in electrical contact with both power source terminals. Occasionally, these arrangements fail because the switch assembly does not move the strip sufficiently to engage the contact disc. This shortcoming is attributed in part to loss in spring action in the contact strip. Generally, these contact elements are permanently secured in the assembly and cannot be readily replaced.

Most lanterns contain some sort of a handle means which is generally an integral element of the body. As in the present invention, it may contain the switch assembly. These handles are either open, i.e., the hand can slide in from the back; or closed, i.e., the hand can grasp only by placing the fingers in from the side. The former configuration is generally preferred.

THE PRESENT INVENTION

The present invention is directed to a portable, self-contained lighting device which comprises a separate head assembly with handle base secured to a body assembly containing the power source and remainder of the handle, wherein (a) the head assembly contains the electrical contact, switching and bulb contact elements that cooperate to change the position of the bulb depending on the presence or absence of the power source; and
(b) the body assembly provides a portion of the handle and has provisions for containing the power source and maintaining one terminal of the power source in continuous electrical contact with a bulb retainer while the other power source terminal is in electrical contact with a contact disc.

More specifically, the improvements in the portable, self-contained lighting device of the present invention are in bulb positioning, switching, and electrical contact wherein I. When the power source is absent, (a) the combination of
  (1) a bulb restrictor element in the electrical contact strip, said element having a biasing flex,
  (2) a fixed reflector having two opposing slots adjacent to the core, and
  (3) a bulb retainer which is slidably mounted in the slots of the reflector core, having a base which is capable of making electrical contact with the central terminal of the power source, (b) results in a force away from the reflector by the biasing flex in the restrictor element such that the terminal flanges of the retainer are seated against the reflector adjacent to the slots, thereby maintaining the bulb substantially free from movement; and II. When the power source is present, (a) the combination I.(a) results in a force on the bulb retainer base toward the reflector by the power source terminal spring, sufficient to overcome the biasing flex in the bulb restrictor thereby seating the bulb flange against the flattened bulb restrictor which is seated against the inner face of the reflector core, and (b) maintains electrical contact with the bulb terminal and optimum bulb focus relative to the fixed reflector;

III. The rotating switching element is positioned substantially directly above the bulb, and IV. The electrical contact strip is preloaded in the "off" position against the switching element and has an inherent over-travel of up to about 50% with a flexible knee member capable of changing by up to 40°.

In the present invention a portion of the handle in the head assembly provides a means at its outermost edge to aid in securing the head assembly to the body assembly in the general area of the switch. The base of the handle preferably provides the housing around the contact strip in the area where it engages the contact surface of the switch assembly.

Generally, it is preferred that the handle of the present invention have a slope approximately 45° to the axis of the reflector in order to accommodate the operation of the switch assembly and that the handle extend from the lens to the base of the body assembly.

The lighting device of the present invention is generally larger than a two-cell flashlight and is usually described as a lantern. Such lanterns are generally powered by a six-volt battery or a series of batteries that have a voltage of about six volts.

SUMMARY

The present invention overcomes the shortcomings of previous portable, self-contained lighting devices, it being a primary object of the present invention to provide a portable, self-contained lighting device with improved bulb positioning and improved reliability of the switch and electrical contact components wherein (a) the head assembly contains the electrical contact, switching, and bulb positioning components and the handle base;

(b) the body assembly is devoted exclusively to providing a portion of the handle and to containing the power source and maintaining the power source in continuous electrical contact with the light component and the electrical contact element in the head assembly;

(c) the head assembly and body assembly are secured together by a series of living hinges and corresponding seats, to assure substantially uniform electrical contact between one terminal of the power source and the contact disc, and between the second power source terminal and the light source;

(d) the slope of the handle base on the head assembly is such that the toggle switch assembly which is located in the handle and generally above the bulb pivots in an arc transverse to the beam of light where the arc is from between 15° to about 30°, the slope of the handle is up to about 45° to the axis of the reflector;

(e) electrical contact between the switch assembly and the bulb is by means of an electrical contact strip which at one end engages the bulb at its base by means of a bulb restrictor having a biasing flex element, which holds the bulb base against a movable bulb retainer that has prongs slidably mounted in slots of the reflector adjacent the core, while the other end of the strip is preloaded against a foot element in the switch assembly;

(f) the base of the bulb retainer has a seat member for the bulb terminal with two legs extending below the base which define the contact area for the central power source terminal spring, which passes through an aperture in the electrical contact disc; the second spring terminal of the other power source makes electrical contact with the contact disc; the contact disc also provides a contact base for the contact knee element of the electrical contact strip;

(g) the switch assembly leg engages one end of the electrical contact strip which is substantially parallel to the tangent line at the center of the arc defined by the rotation of the switch assembly, thereby resulting in a mechanical advantage of movement relative to the switch assembly of approximately one;

(h) neither the bulb nor the bulb retainer are fixedly secured in the core of the reflector, but rather are dynamically mounted and free to move, depending on the presence or absence of the power source; yet, both are constantly under restriction either from the engagement of the biasing element in the bulb restrictor and/or from the force applied to the bulb retainer base by the power source terminal spring; thus, this mode of dynamic bulb positioning protects the bulb in the absence of the power source, achieves optimum bulb focus relative to the fixed reflector in the presence of a power source, and assures that bulb movement occurs substantially in the axial plane and not laterally;

(i) the electrical contact strip is provided with a preload force in the "off" position such that inadvertent actuation of the switch assembly is minimized, while the potential travel of the contact strip is substantially greater, i.e., up to 50% greater, than the gap between the electrical contact strip and the contact disc; this over-travel is compensated for by the flexing of a knee member in the contact strip that undergoes up to a 40° change when the switch assembly moves from the "off" position to the "on" position.

Another object of the invention is to provide an improved portable, self-contained lighting device where bulb and power source replacement is substantially straight-forward and free from error.

Still another object of the invention is to provide an improved portable, self-contained lighting device that has improved operational reliability.

Yet another object of the invention is to provide an improved portable, self-contained lighting device wherein one terminal of the power source is in direct contact with a bulb retainer element.

A still further object of the invention is to provide a lighting device where the bulb position in the reflector core is responsive to the presence or absence of the power source.

Another object of the invention is to provide a lighting device such that in the absence of the power source the bulb is positioned such that the flange thereof is free from direct contact with a fixed reflector core element.

Yet another object of the invention is to provide a lighting device wherein the electrical contact strip and the bulb retainer are replaceable.

These and other objects of the invention are described in the following specification and claims.

DESCRIPTION OF THE FIGURES

FIG. 2 shows the switch in the "on" position and the power source in place. FIG. 3 shows the switch in the "off" position and the power source not present. FIG. 2 also illustrates the suspension of the bulb by the electrical contact strip and one of the power source terminals.

FIGS. 4, 5 and 6 illustrate the location of the switch on the handle. FIGS. 5 and 6 also illustrate the living hinges used to secure the head assembly to the body assembly.

DETAILED DESCRIPTION

Head/Body Assembly

Figure 1:
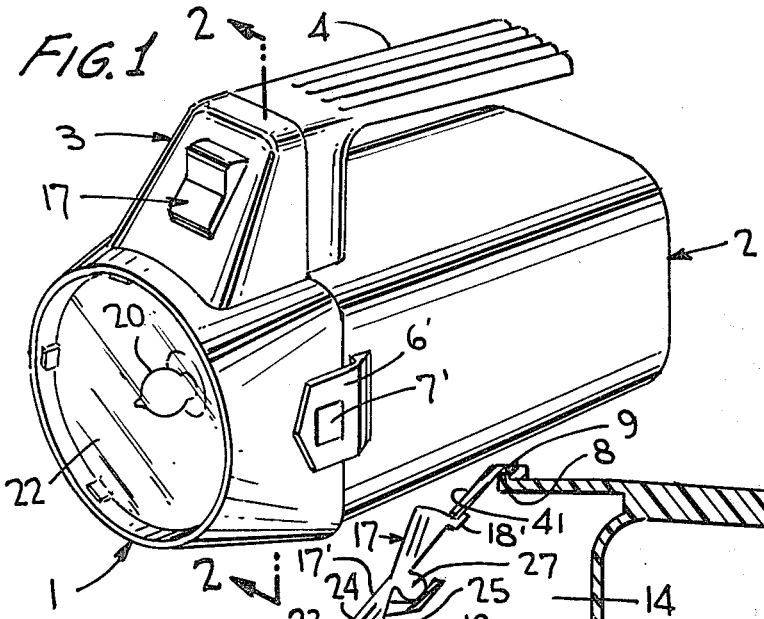
FIG. 1 is a perspective view of one embodiment of the portable, self-contained lighting device of the invention.
Figure 2:
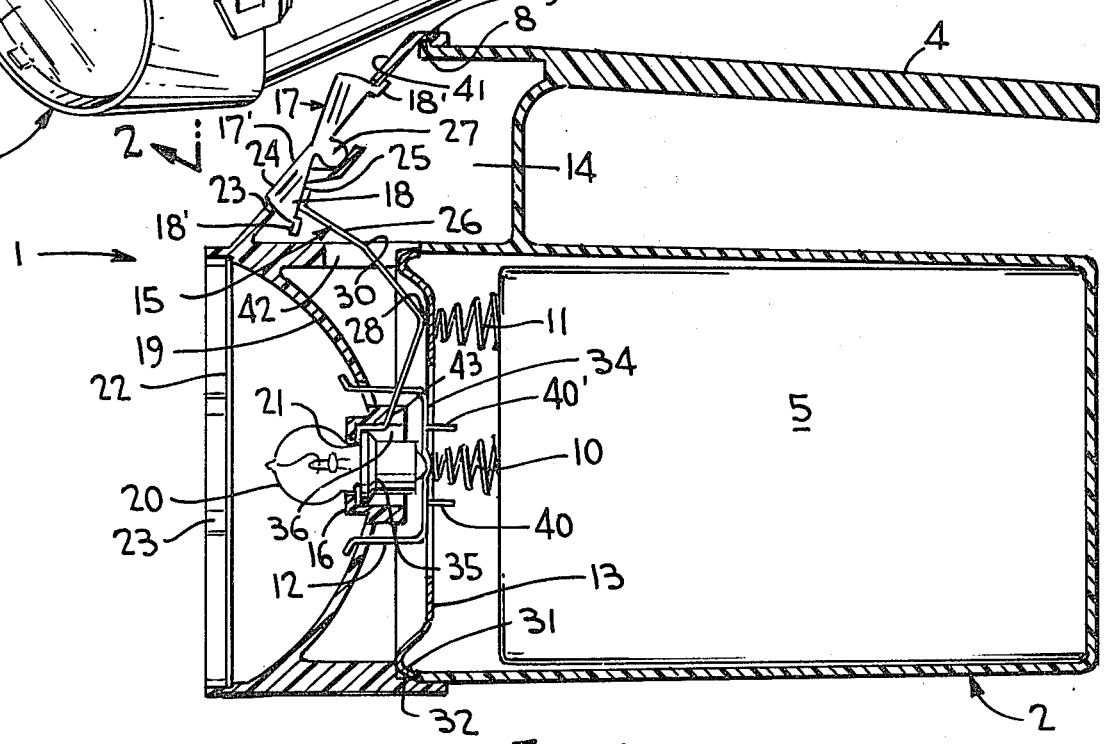
FIGS. 2 and 3 are each a cross-sectional, elevational view of the device shown in FIG. 1 taken along line 2—2.

Referring first to FIG. 1, the portable, self-contained lighting device of the invention comprises a head assembly 1 fixedly secured to a body assembly 2. The head assembly contains the electrical contact, lighting, switching components, and handle base 3, as shown in detail in FIGS. 2–9, and discussed in detail below. The body assembly contains the grip element of the handle 4 and power source 5 as shown in FIG. 2.

Figure 6:
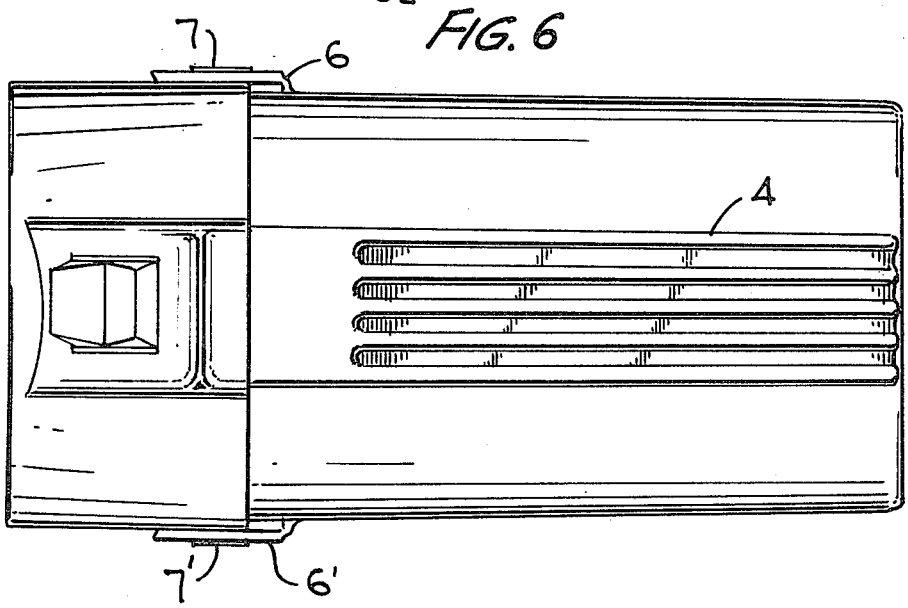
FIGS. 4, 5, 6 and 7 are front elevational, side elevational, and plan and elevational rear views, respectively, of the lighting device shown in FIG. 1.
Figure 3:
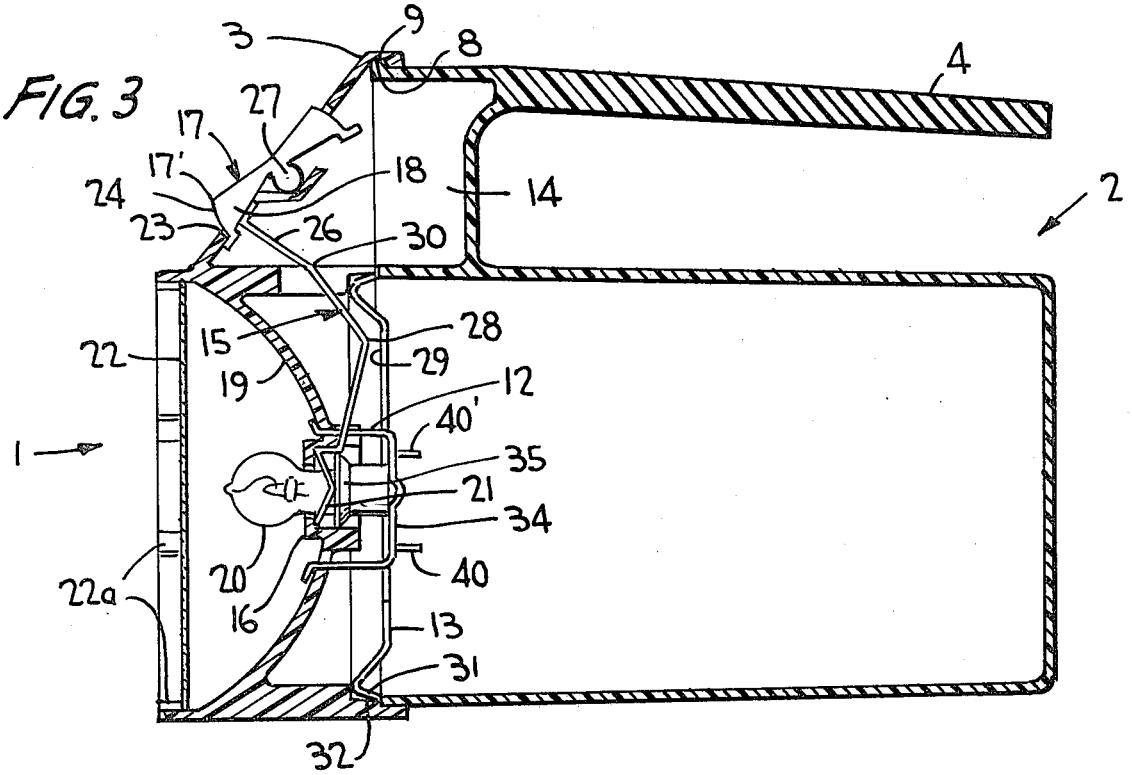

The head assembly is secured to the body assembly by means of a pair of living hinges with corresponding seats. One hinge is shown as 6 and the seat as 7 in FIG. 5. Both hinges 6 and 6' and seats 7 and 7' are shown in FIG. 6. These hinges cooperate with a body securing riser 8 located in grip element 4 of the handle, and corresponding head assembly channel 9. This arrangement is shown in FIGS. 2 and 3. The net result of this combination of securing means is to secure the head assembly to the body assembly such that a consistent and reliable electrical contact is obtained between power source terminals 10 and 11, contained in body 2, and bulb retainer 12 and contact disc 13 located in head assembly 1.

Preferably head assembly 1 and body assembly 2 are molded from a plastic material such as high-impact styrene or ABS. Switch assembly 17 can be molded from various plastic materials including polypropylene.

Handle/Switch Assembly

The grip element 4 of the handle as illustrated in FIGS. 2 and 3 provides the housing 14 for contact strip 15. Preferably, the handle base 3 has a backward slope of at least about 45° to the axis of reflector core 16. The backward slope of handle base 3 in combination with pivoting switch assembly 17 provides a preferred means for actuation of the switch, and minimizes inadvertent switch actuation. That is, the force required to overcome the preload force in contact strip 15 which engages switch 17 at contact area 18 in combination with lip 18' and the location of the switch assembly on handle base 3 requires a definite force be applied to switch pad 17' to actuate.

The toggle switch assembly 17 located in slot 23 of handle base 3, as shown in FIGS. 2, 3, 6, 8 and 9, is a most critical aspect of the device of the present invention. That is, the location of the switch assembly 17 remote from the head and body assemblies and forward of power source 5 and substantially directly above bulb 20 in switch assembly aperture 23, in combination with the slope of handle base 3 and the pivotal movement of switch assembly 17 on pin 27 when rotating from the preloaded state in "off" to "on," results in optimum switch actuation. Switch assembly 17 is moved by pressing downward against thumb plate 24 and rotating switch assembly 17 downward as shown in FIG. 2. The switch assembly pivots on pin 27 in an arc generally transverse to the beam of light, with an arc from between 15° to about 30°.

It is evident from FIGS. 2 and 3 that switch assembly 17 is positioned above bulb 20 and forward of power source 5. This arrangement is such that the weight of the power source in combination with grip element 4 of the handle, the slope of handle base 3, the location of the switch 17 in aperture 23, and the arc through which the switch 17 rotates on pin 27 produces a slight "rocking" motion upon actuation of the switch, which is preferred.

When switch assembly 17 is rotated to the "on" position, lip 18' engages handle base 3 at switch retainer area 41 as shown in FIG. 2.

Figure 7:
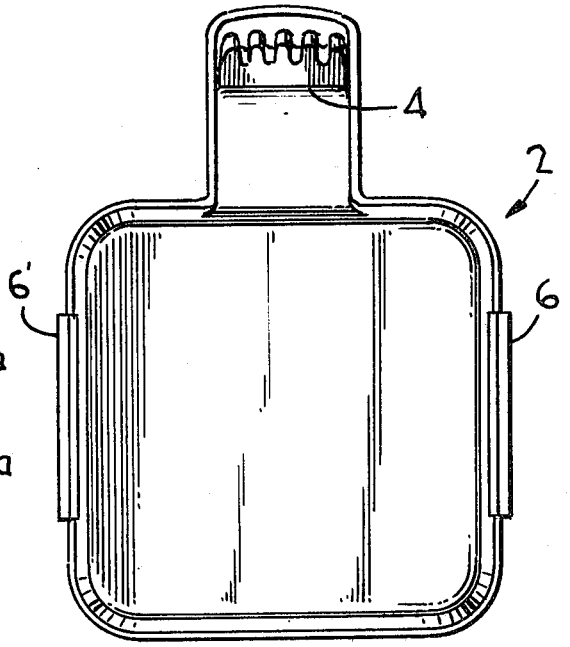
Figure 5:
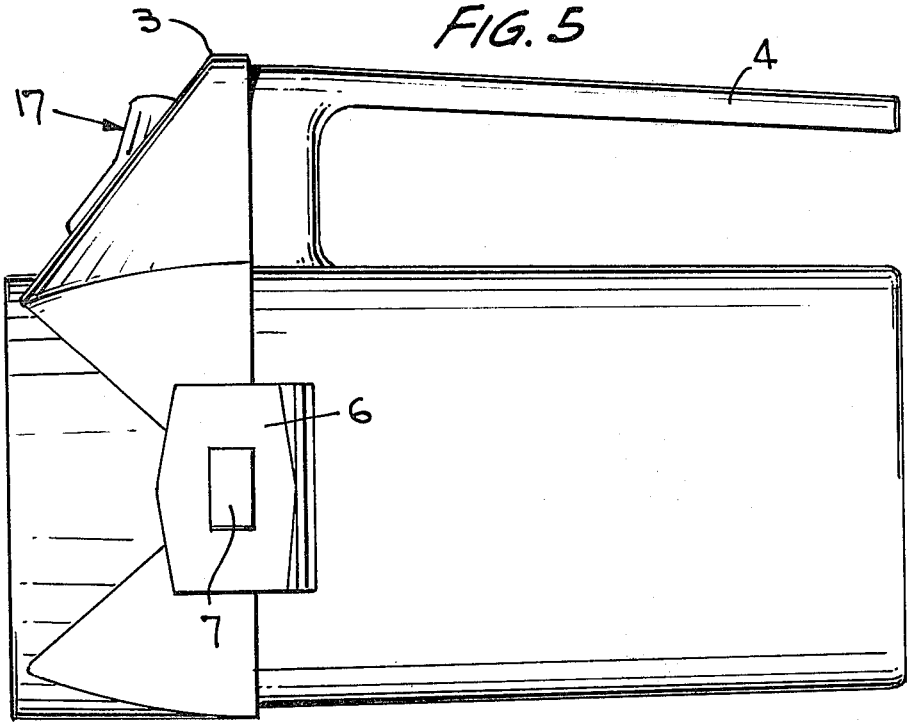
Figure 8:
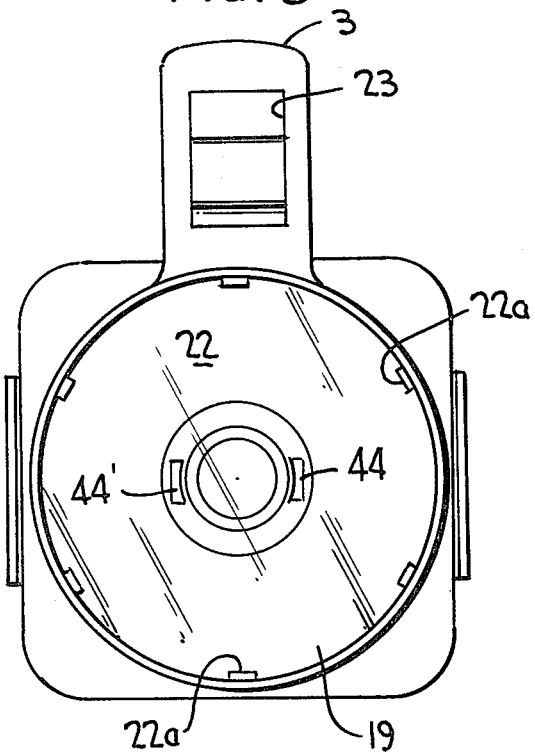
FIGS. 8 and 9 are front and rear elevational views, respectively, of the head assembly without the electrical and bulb components.
Figure 9:
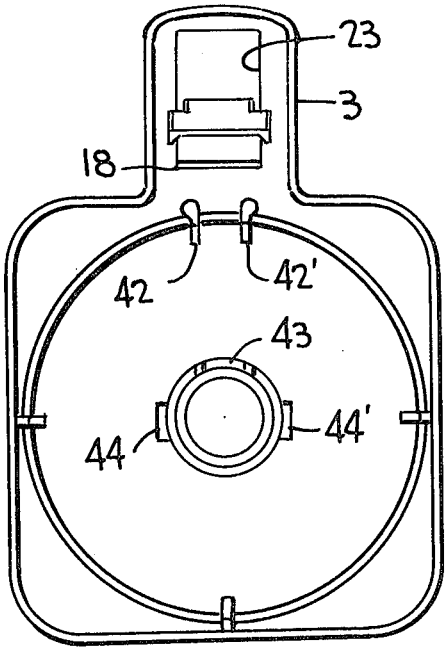
Figure 12:
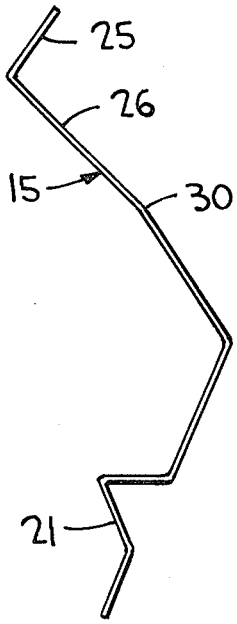
FIGS. 12 and 13 are side elevations and plan views, respectively, of the electrical contact strip illustrating the bulb restrictor with its biasing element and the flexible contact knee element.
Figure 13:
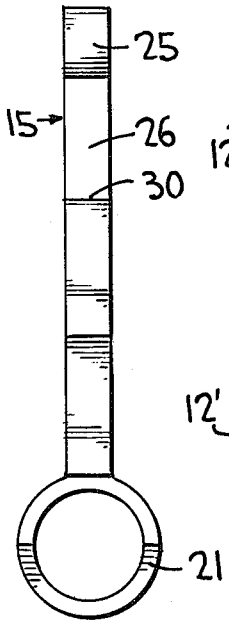

Referring to FIGS. 3, 7 and 8, switch contact area 18 of switch 17 engages contact arm 25 of electrical contact strip 15. At this point electrical contact strip 15 is preloaded in the "off" position and generally is held firmly against contact area 18 such that substantial force is required on thumb plate 24 to rotate switch assembly 17 to the "on" position. The slope of handle element 3 in combination with this preload condition of contact strip 15 and the pivoting nature of toggle switch 17 around pin 27 assures that inadvertent actuation of the device is minimized. This preload is obtained by the design of contact strip 15 which is illustrated in FIGS. 3, 12 and 13. Contact strip 15 extends from contact area 18 through guides 42 and 42' in the head assembly and port 43 in the reflector core. These are shown in FIG. 9. Generally the device is shipped in the "off" position without a power source.

Contact Strip

Referring to FIGS. 2, 3, 12 and 13, it is seen that the design of contact strip 15 is such that flexing of knee element 26 is parallel to the tangent line at the center of the arc defined by the rotation of switch assembly 17 at pin 27, thereby resulting in a mechanical advantage of movement of knee element 26 relative to switch assembly 17 of about one.

The travel potential of contact strip 15 upon actuation of switch 17 is substantially greater than the gap between switch strip contact zone 28 and contact disc 13 at disc contact area 29. This over-travel potential can be 50% or greater of the distance between contact zone 28 and disc contact area 29.

The over-travel in contact strip 15 is necessary to assure consistent electrical contact performance over the life of the device. This over-travel is adjusted for in contact strip 15 by flexing knee 26 at 30. Flexing knee 26 has the capacity to effect up to about a 40° change in the angle at 30 when switch assembly 17 moves from "off" to "on." Preferably, this flexing is achieved with the angle at 30 capable of substantially total recovery. The nature of the contact strip arrangement is such that the strip can be removed and new strip substituted therefor, or the strip can be taken out, modified, and returned to the assembly.

Contact strip 15 is fabricated of a metal such that it (a) conducts electricity, (b) is flexible, (c) has memory, (d) is capable of imparting the inherent spring force required to preload switch 17 in the "off" position, and (e) can effectively grip bulb 20 at restricting element 21 while imparting a downward force on bulb 20 sufficient to seat bulb retainer lips 12' against the reflector surface adjacent guides 44 and 44'.

Contact Disc

Referring to FIGS. 2, 3, 14 and 15, contact disc 13 is secured to head assembly 1 by means of seat member 31 located at the perimeter of disc 13 which engages contact disc securing channel 32 of the head assembly. The seating of seat member 31 in channel 32 is critical to the performance of the device. That is, the electrical contact by disc 13 with power source 5 is limited to one spring terminal 11 which tends to tip disc 13 unless disc 13 is seated effectively in the head assembly at 32. Aperture 33, shown in FIG. 15, allows central terminal spring 10 to contact base 34 of bulb retainer 12.

Bulb Positioning

Figure 14:
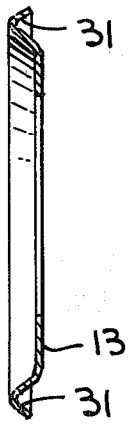
FIGS. 14 and 15 illustrate the side elevational and plan views of the contact disc shown in FIGS. 2 and 3.
Figure 15:
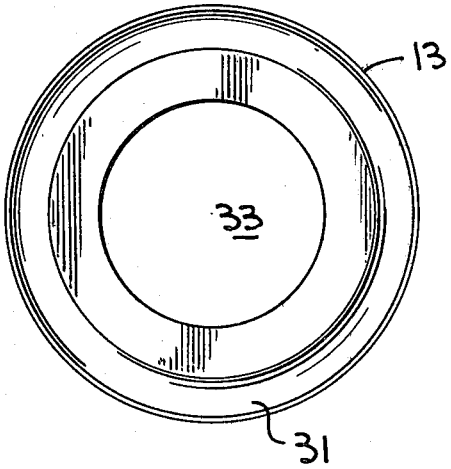

Referring to FIGS. 2, 14 and 15, central power source terminal 10 passes through aperture 33 in disc 13 to make direct contact with base element 34 of bulb retainer 12. Thus, terminal spring 10 functions as a bulb positioning element. That is, spring 10 overrides the downward force of bulb restricting element 21 forcing retainer 12 upward towards bulb 20, seating bulb collar 35 against bulb restricting element 21 which has been flexed open such that it is flattened and held against reflector core terminal 36. Thus, the spring force of terminal 10 moves bulb 20, retainer 12, and restricting element 21 such that bulb 20 is in the optimum position in reflector core 16, to provide the preferred bulb focus. This dynamic positioning of bulb 20 is most unique since the assembly does not have the traditional screw shell-/bumper block arrangement. Bulb retainer 12 is provided with feet 40 and 40' that are capable of flexing inward so that retainer lips 12' can be moved inward and into slots 44 and 44', and bulb retainer 12 removed from the reflector core so that bulb 20 can be replaced.

Figure 10:
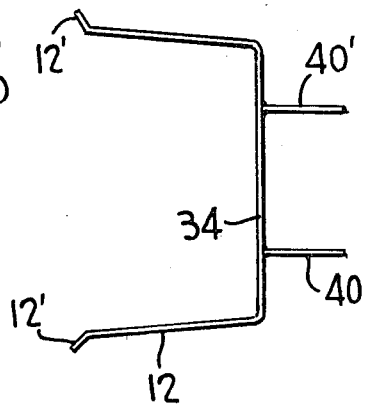
FIGS. 10 and 11 are side elevational and bottom views, respectively, of the bulb retainer shown in FIGS. 2 and 3.
Figure 11:
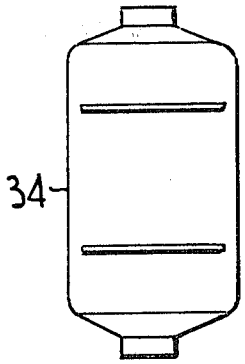

Referring to FIGS. 3, 10 and 13, in the absence of power source 5, bulb 20 is gripped by restrictor element 21 of contact strip 15, forcing retainer lips 12' to be seated in guides 44 and 44' of reflector 19, with bulb terminal 37 seated in bulb retainer base 12. It is in this position that bulb 20 is generally held prior to the sale of the device. That is, most devices are sold sans the power source. The inherent "axial mobility" of bulb 20 with and without the power source is a distinguishing feature of the device of the present invention. That is, there is limited bulb movement in the traditional bumper block/screw shell arrangements employed heretofore. The dynamic positioning of the present invention is preferred for bulb protection, longer bulb life, and consistent bulb positioning. Heretofore, bulbs have been observed to be positioned off-center, tilted or cocked if bulb terminal 37 gets "caught" off-center in the bumper block spring. The contact between bulb terminal 37 and bulb retainer base 34 in the present invention is considered more reliable than the terminal/spring arrangement used heretofore in bumper block assemblies.

Reflector

Figure 4:
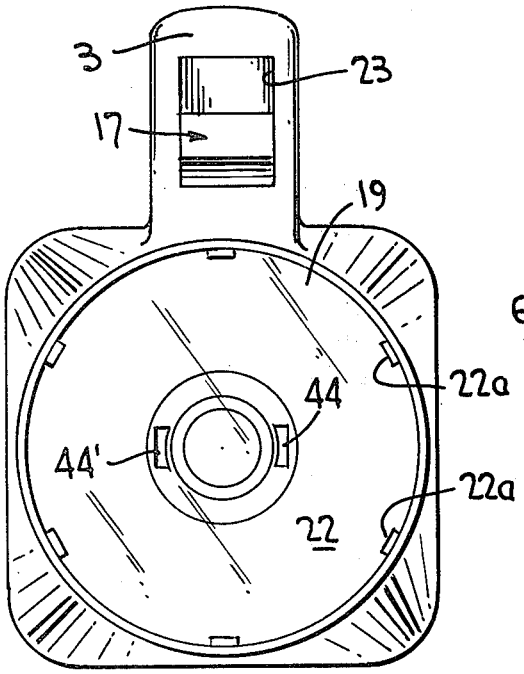

Referring to FIGS. 2, 3, 8 and 9, to obtain optimum performance, the reflector 19 is integral with head assembly 1, and bulb retainer 12 is slidably mounted in slots 44 and 44' adjacent to reflector core aperture 16 located at the axis of the reflector. At this time it is noted that in each of FIGS. 2 and 3 slots 44 and 44' are shown displaced 180° for clarity. The correct positioning of slots 44 and 44' is shown in FIGS. 4, 8 and 9. Electrical contact strip 15 engages bulb 20 by means of restrictor element 21 and holds bulb 20 in aperture 16 along with bulb retainer 12. Preferably contact strip 15 circumvents bulb 20 with restrictor element 21 which also grips bulb 20 and positions bulb 20 in aperture 16, and holds lips 12' of bulb retainer 12 seated against reflector 19 in guides 44 and 44'.

The surface 26 of reflector 19 is preferably a smooth metallic finish generally produced by some form of metalizing such as vacuum metalizing. The metalizing of a portion of the plastic surface of reflector 19 results in a static charge being built-up on the resulting reflective surface which makes it particularly susceptible to contamination by dust. In addition, this surface can be permanently contaminated if it is touched by the consumer during bulb or power source replacement. Therefore, as illustrated in FIGS. 2 and 3, the reflector surface 26 is provided with lens 22 which is press-fitted under detents **22*a* at the periphery of the reflector 19**.

It is claimed:

1. A portable, self-contained lighting device comprising a head assembly containing the bulb, bulb positioned means, reflector, switch, electrical contact components and a body assembly with provisions for holding a power source in electrical contact with certain elements of the head assembly, wherein (a) a rotating switch assembly is positioned in a handle remote from the head/body assembly substantially directly above the bulb, and (b) an electrical contact strip (1) is preloaded against the switch assembly in the "off" position, (2) has an over-travel capacity of up to about 50%, (3) has a compensating flexible knee capable of changing by up to about 40°, and (4) has a flexed bulb restrictor element which engages the bulb at the bulb base and imparts an axial force on the bulb generally away from the reflector core, (c) the bulb is housed in a two-pronged, U-shaped bulb retainer that is slidably mounted in slots adjacent the reflector core which engages the bulb terminal at its base and cooperates with the bulb restrictor and the central power source terminal spring to change the position of the bulb axially depending on the presence of the power source, and (d) a circular electrical contact disc secured to said head assembly at its perimeter with (1) a central aperture for allowing the central power source terminal spring to contact the base of the bulb retainer, and (2) a contact rim that engages the electrical contact strip in the general area of the compensating flexible knee.

2. A device according to claim 1 wherein said handle base is positioned at an angle of approximately 45° to the axis of the reflector and the handle base together with the grip extends substantially the length of the device.

3. A device according to claim 1 wherein in the absence of a power source the bulb restrictor element of the contact strip forces the bulb axially away from the reflector and causes the prongs of the bulb retainer to seat against the reflector.

4. A device according to claim 1 wherein in the presence of a power source the central spring of the power source engages the bulb retainer at its base and forces the bulb flange against the bulb restrictor moving the bulb axially such that it is against the reflector core.

* * * * *